US005211093A

United States Patent [19]

Horniak

[11] Patent Number: 5,211,093

[45] Date of Patent: May 18, 1993

[54] APPARATUS FOR COUNTING AND DISPOSING OF TICKETS AND METHOD OF USING SAME

[76] Inventor: Stephen Horniak, 424 Cedar Hill Rd., Ambler, Pa. 19002

[21] Appl. No.: 602,418

[22] Filed: Oct. 22, 1990

[51] Int. Cl.[5] ..... B26D 01/143

[52] U.S. Cl. ..... 83/426; 83/491; 83/435; 83/436; 83/734; 83/522.29

[58] Field of Search ..... 83/13, 37, 298, 425, 83/426, 436, 434, 435, 734, 522.29, 929, 952, 242, 491, 500–502

[56] References Cited

U.S. PATENT DOCUMENTS

| | | | |
|---|---|---|---|
| 208,754 | 10/1878 | Morgan | 83/522.29 |
| 1,605,644 | 11/1926 | Carnahan | 83/949 |
| 2,000,159 | 5/1935 | Bolognino | 83/522.29 |
| 2,036,207 | 4/1936 | Feddern et al. | 83/500 |
| 2,097,485 | 11/1937 | Helsel | 83/522.29 |
| 2,232,106 | 2/1941 | Fishburn | 83/500 |
| 2,487,061 | 11/1949 | Ptasnik . | |
| 3,621,964 | 11/1971 | Riddle et al. | 250/548 |
| 3,677,122 | 7/1972 | Rautine | 83/425 |
| 3,782,616 | 1/1974 | Surber, Jr. . | |
| 4,272,001 | 6/1981 | Horniak . | |

FOREIGN PATENT DOCUMENTS

| | | | |
|---|---|---|---|
| 0086057 | 8/1920 | Switzerland | 83/734 |
| 0645798 | 11/1950 | United Kingdom | 83/500 |

*Primary Examiner*—Frank T. Yost
*Assistant Examiner*—Allan M. Schrock
*Attorney, Agent, or Firm*—Ferrill and Logan

[57] ABSTRACT

The present invention provides an apparatus and method for automatically counting and permanently disposing of tickets and similar markers, such as those dispensed at arcades. The apparatus employs motor driven wheels to draw tickets through it in very rapid fashion, a sensor and counter to tally the number of tickets, and a blade to permanently destroy the tickets. The present invention lends itself to many security and accounting protections presently unavailable using conventional manual systems.

13 Claims, 4 Drawing Sheets

APPARATUS FOR COUNTING AND DISPOSING OF TICKETS AND METHOD OF USING SAME

BACKGROUND OF THE INVENTION

1. Field of the Invention

The present invention relates to apparatus and method for handling tickets, stamps and other markers. More particularly, the present invention provides an apparatus and method for rapidly and effectively counting and disposing of used tickets.

2. Description of the Prior Art

It is a widely employed practice today for various arcade machines, such as skee-ball, pin-ball, and Whak-a-Mole, to issue tickets or similar markers as premiums for high scores. Usually multiple attached tickets are dispensed from these machines from a long continuous roll of tickets. Additionally, tickets and stamps are regularly dispensed automatically from other machines for a variety of reasons, again usually from a continuous roll. Since it is a regular occurrence for customers to acquire large numbers of such tickets, it has become an increasing concern for operators of such machines to find some rapid and accurate way to count such tickets when they are redeemed. Moreover, since many of these tickets have a substantial value for redemption purposes, operators are also quite concerned that each ticket is redeemed only once and is not "recycled" by dishonest customers or wayward employees for further redemption.

A number of advances have been made in the security of the machines which dispense such tickets. One such advance in wide use today is applicant's U.S. Pat. No. 4,272,001, issued Jun. 9, 1981. This patent discloses a ticket dispenser with a built-in brake which prevents the unauthorized removal of tickets from an arcade game or similar ticket dispenser.

Despite such advances, it is still common for arcade operators to count the redeemed tickets manually. This laborious procedure is slow, tedious, and inaccurate. Additionally, since counting of such tickets is not easily accomplished, owners tend to be at the mercy of their employees with respect to accounting for the number of prizes awarded relative to the number of tickets redeemed. Furthermore, unless a separate step is employed to deface such tickets somehow after redemption, it is known that a certain number of previously redeemed tickets tend to recirculate via scavenging of trash receptacles or by way of dishonest employees. This form of theft needlessly undermines the profit of any arcade or similar operation.

Accordingly, it is a primary object of the present invention to provide an apparatus and method of automatically counting redeemed tickets and other markers in a manner which is both rapid and accurate.

It is a further object of the present invention to provide such an apparatus and method which provides an objective and verifiable count of the total number of tickets redeemed.

It is an additional object of the present invention to provide such an apparatus and method which automatically defaces any redeemed tickets so to assure that they cannot be reused in the future.

Other objects of the present invention should become evident through review of the following specification.

SUMMARY OF THE INVENTION

The present invention provides an apparatus which automatically counts and destroys tickets and markers. The present invention is of particular benefit for applications, such as arcades, where large number of tickets must be quickly and accurately counted and disposed of.

The apparatus employed with the present invention comprises motor driven wheels which draw tickets into and through a ticket path, a sensor which detects and counts gaps between the tickets, and a rotating blade which permanently destroys the tickets once they have been counted. Through use of various gearing and transmission devices, the present invention effectively operates both the drive wheels and the cutting blade through use of a single motor. The sensor may be used to generate both crucial individual and total ticket count information, and may be easily modified to interface with more advance electronics to provide other information which may be of interest to the owners and operators of such apparatus.

The present invention provides an extremely fast and accurate means of counting tickets while providing a number of forms of accounting and security which would be difficult if not impossible to achieve using presently available manual systems.

DESCRIPTION OF THE DRAWINGS

The operation of the present invention should become apparent from the following description when considered in conjunction with the accompanying drawings, in which.

DETAILED DESCRIPTION OF THE INVENTION

The present invention provides an apparatus for automatically counting and invalidating all forms of tickets, such as those commonly employed for redemption at various arcades. Although the term "ticket" is used throughout this application, it should be understood that the present invention operates equally as well in the handling of tickets, stamps, and other markers; the term "ticket" is intended to include all forms of markers which may be counted and/or invalidated by such an apparatus.

Figure 1:
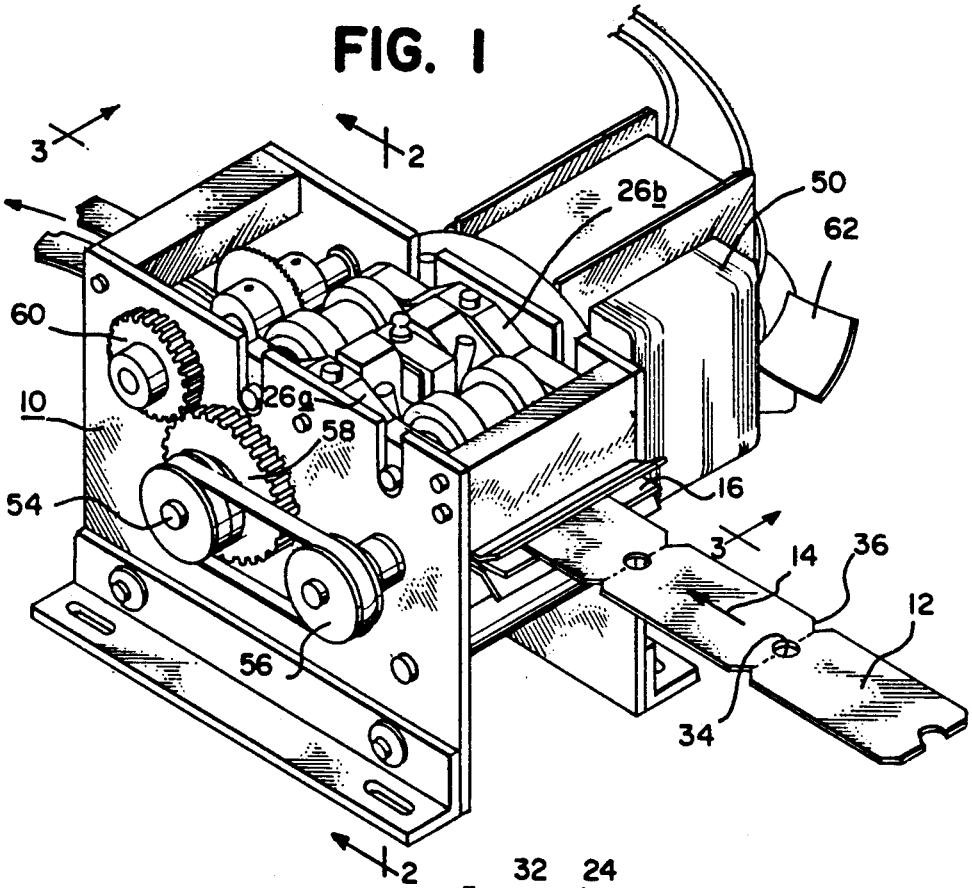
FIG. 1 is a three-quarter side elevational view of one embodiment of the present invention, showing the orientation of idler wheels and cutting wheel employed in the present invention.
Figure 2:
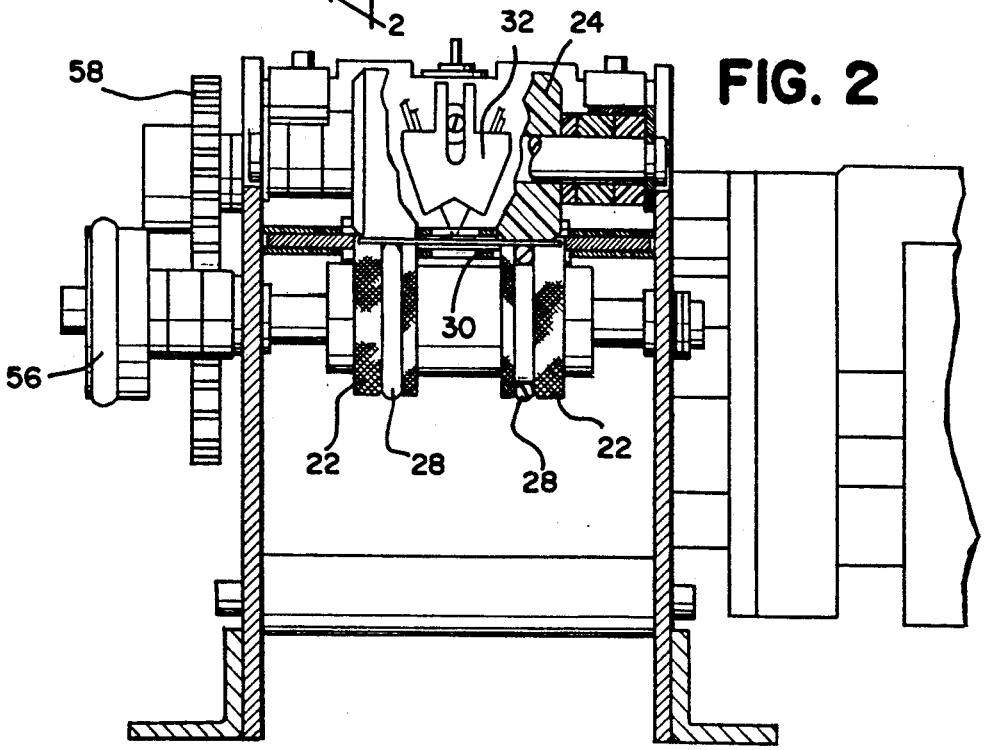
FIG. 2 is a cross-sectional view of the present invention along line 2—2 of FIG. 1.
Figure 3:
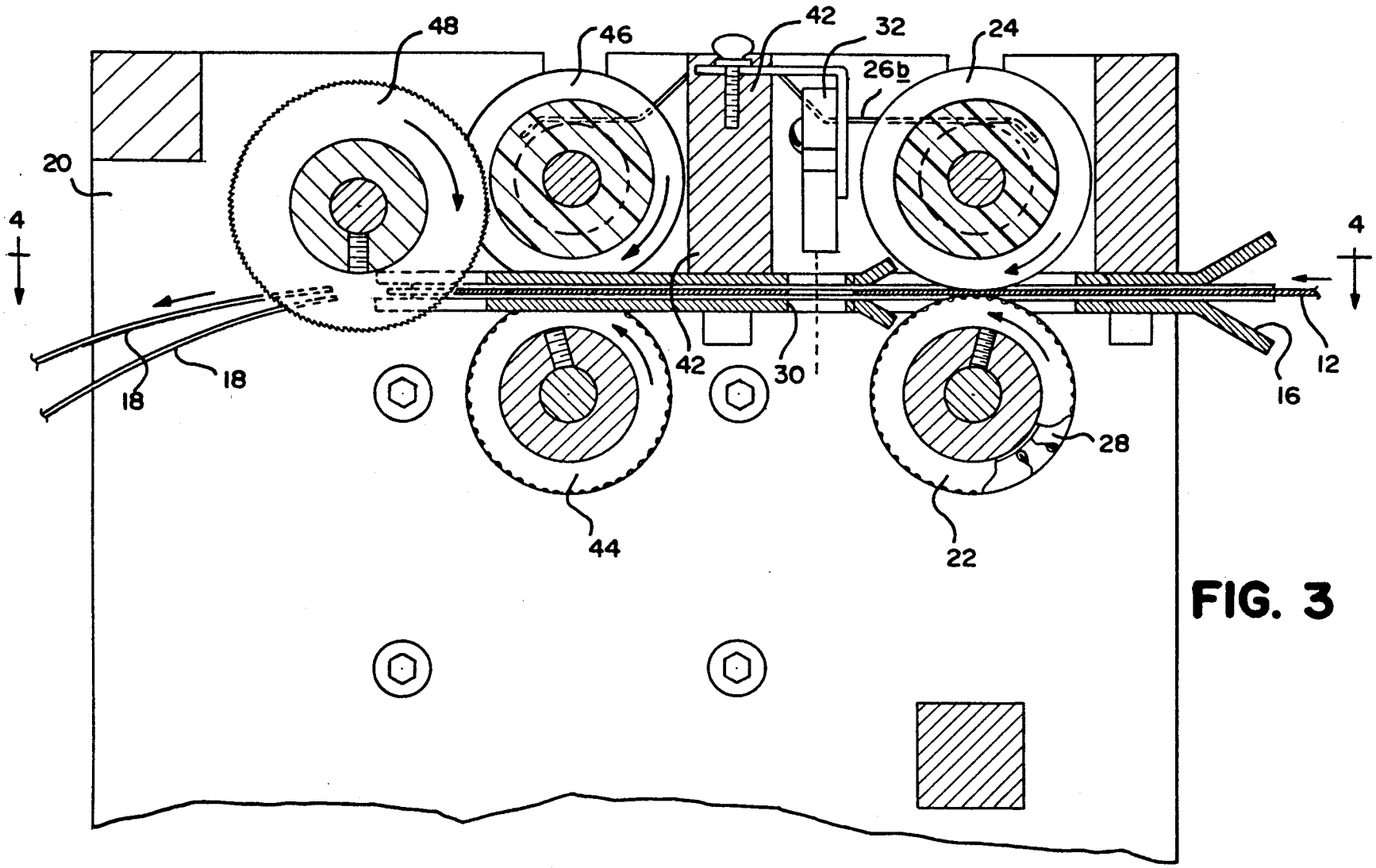
FIG. 3 is a longitudinal sectional view of the present invention along line 3—3 of FIG. 1.

As is shown in FIGS. 1 through 3, the apparatus 10 of the present invention is designed to receive tickets 12 into a ticket path 14 at the receiving end 16 of the apparatus 10. The tickets 12 may be received either individually or in roll form. The apparatus then counts the tickets 12, and slices them longitudinally in half into a shredded output 18 which is expelled from the dispensing end 20 of the apparatus.

The tickets 12 are drawn into the apparatus 10 by a first set of drive wheels 22 mounted on the lower side of the ticket path 14 and a first set of idler wheels 24 mounted on the upper side of the ticket path 14. In order to assure proper traction on the tickets 12, it is important that the drive wheels 22 and the idler wheels 24 remain in close proximity to each other at all times during operation. Accordingly, some bias means, such as a spring device or elastomer bushing, should be provided which maintains the contact between these wheels. In the preferred embodiment shown, a spring clip 26*a*, 26*b* is provided on each side of the idler wheels 24 to assure adequate pressure against the drive wheels 22.

The wheels may be constructed from any desired material. In the preferred embodiment, the drive wheels are constructed from a durable metal, such as brass, and include a center O-ring 28, of rubber or similar elastomer, which provides adequate friction against the tickets 12. The idler wheels 24 are preferably constructed from a hard and durable plastic or metal.

Once the tickets 12 are drawn into the ticket path 14, they are driven by an opening 30 in the path 14 in which is mounted a sensor 32. In the preferred embodiment the sensor 32 is a reflective type sensor which responds to interruptions in reflection of light. One suitable type is a VTR 17E1 model sensor manufactured by EG & G Vactec of St. Louis, Mo.

Figure 4:
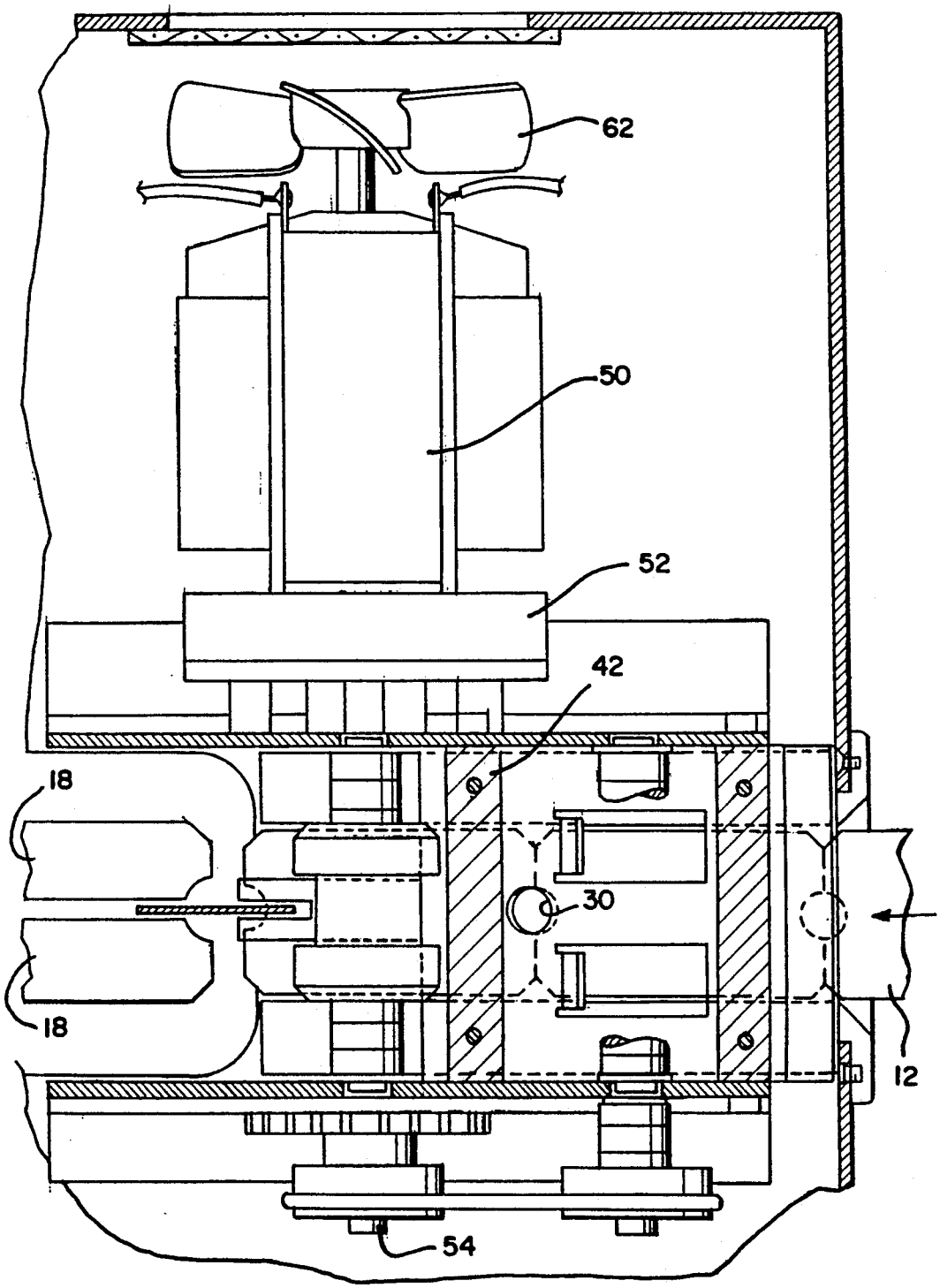
FIG. 4 is a sectional view of the present invention along line 4—4 of FIG. 3.

The sensor should be positioned to respond to known gaps between the tickets 12, such as openings 34 commonly placed in the center between each ticket or notches 36 commonly placed on the side between each ticket. As each such gap passes the sensor 32, the presence of one ticket is duly noted. As is illustrated in FIG. 4, the ticket sensor 32 then sends a signal to a control board 38. Employing relatively simple electronics of known construction, the control board 38 then registers a count of one ticket on one or more counters 40*a*, 40*b*. It should be appreciated that the output from either the sensor and/or the control board may be either analog or digital and that the counters may take either of these forms. In the presently preferred embodiment of the present invention, the counter is a 7600-6K0 model counter manufactured by Redington Counters, Inc. of Windsor, Conn.

It should be further appreciated that the present invention may be readily adapted to interface with in integrated circuits or computer hardware to provide even more exact measurements, such as precise information on fluctuations in the quantity of tickets redeemed relative to time of day, et cetera.

Once the tickets 12 have passed the sensor 32, they pass under a barrier wall 42 and through a second set of drive wheels 44 and idler wheels 46 which drive the tickets 12 into a rotating cutting wheel 48 positioned in the ticket path 14. As is shown in FIG. 1, the cutting wheel 48 severs the tickets longitudinally in half, producing shredded output 18.

The cutting wheel 48 is preferably a round serrated blade or thin gear wheel which is both durable and effective in defacing the tickets 12. However, it should be noted that the intent of the present invention is also accomplished through use of an ink stamp or marker, a fixed or moving blade or hole punch which scores or otherwise marks the tickets, or any other means which permanently identifies the ticket as having been counted. The advantage of fully severing the tickets 12 is that they cannot be mistakenly reinserted into the apparatus to be counted again.

As should be evident, it is desirable to employ a barrier wall 42 or similar obstruction between the sensor 32 and the cutting wheel 48 to prevent dust from the cutting process from contaminating the sensor.

The second set of wheels 44, 46 may be of the same basic construction as that of wheels 22, 24. As is shown in FIGS. 1 and 2, in the preferred embodiment the same spring clips 26*a*, 26*b* may be used to secure both sets of idler wheels 24, 46.

The drive wheels 22, 44 are rotated by an electric motor 50 through a step-down geared transmission unit 52. The second set of drive wheels 44 are mounted on a drive shaft 54 of the transmission 52. Although a wide variety of motors may be employed with the present invention, the preferred motor is a 12 volt, 3000 RPM motor, such as a 2450-6A1 model motor sold by ECM Motor Co. of Schaumburg, Ill. The transmission, such as a D3H model transmission also manufactured by ECM Motor Company, should reduce the shaft 54 and drive wheel 44 speed to a rate of about 585 to 600 revolutions per minute.

As is shown in FIG. 1, a one-to-one pulley mechanism 56 is employed to transfer the rotation of the drive shaft 54 to an equal rate of rotation for the first set of drive wheels 22. Clearly it is crucial that both sets of drive wheels 22, 44 be driven at the same speed to avoid jamming problems in the apparatus. A large first gear member 58 mounted on the drive shaft 54 meshes with a smaller second gear member 60 which drives the cutting wheel 48. In this manner the cutting wheel 48 is driven at a rate substantially faster than that of the drive wheels 22, 44. It has been found that the cutting wheel should be rotated at a rate of about 1000 to 1200 revolutions per minute to achieve adequate cutting of the tickets.

Since the present apparatus is designed to operate continuously, a fan 62 is provide to assure that the motor 50 does not overheat.

Figure 5:
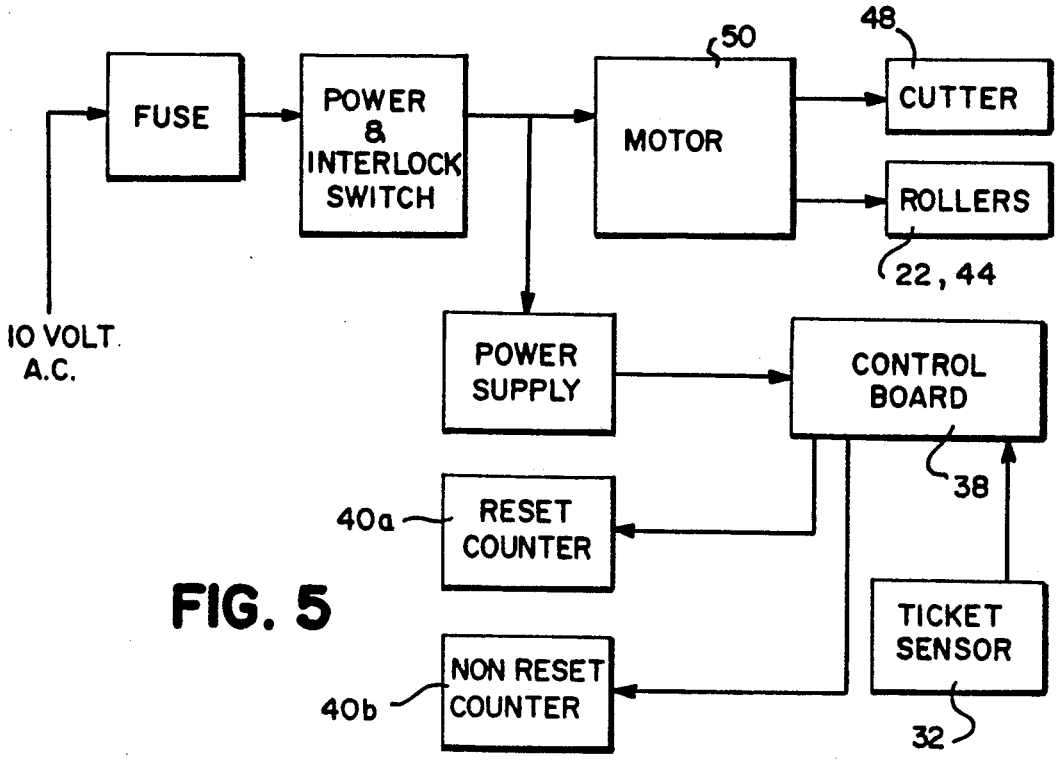
FIG. 5 is a schematic diagram of one embodiment of enabling electronics for the present invention.
Figure 6:
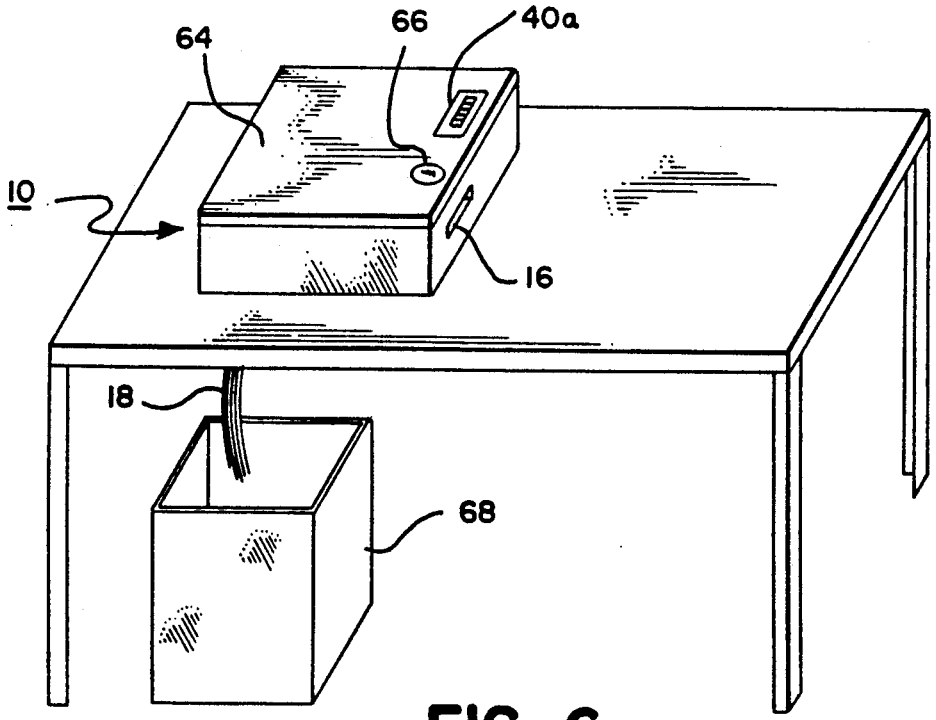
FIG. 6 is a three-quarter view of the present invention as embodied in a protective housing.

As is shown in FIG. 5, the present apparatus may be contained in a housing 64 which protects operators from its many moving parts and secures the apparatus from tampering. In this respect, the housing 64 may easily be provided with a lock 66 to limit access. In this embodiment, the tickets are fed into the receiving end 16 of the apparatus, with shredded output 18 being delivered directly to a waste receptacle 68. A reset counter 40*b* is provided so that the operator can easily provide an accurate count for each customer. One or more other counters, such as the non-reset counter 40*b* provided in FIG. 4, may be included inside the housing 64 to keep track of daily totals and to monitor operator's integrity.

The present invention may be employed with any form or size of ticket, with modification or adjustment required only to a limited degree necessary to assure proper alignment of the sensor 32 with the gaps between the tickets. It should also be evident that the present invention readily lends itself to serve merely as a ticket shredder or as a ticket counter, as necessary.

While particular embodiments of the present invention have been illustrated and described herein, the present invention should not be limited to such illustrations and description. It should be apparent that changes and modifications may be incorporated and embodied as part of the present invention within the scope of the following claims.

What is claimed is:

1. An apparatus for high speed counting and disposal of tickets which comprises:

an assembly housing providing a substantially straight ticket path from a reception end to a disposal end;

first and second sets of wheel members, each set including a drive wheel mounted on one side of the ticket path and an idler wheel mounted on the opposite side of the ticket path, the first set of wheel members being located at the reception end;

sensor means mounted between the first and second sets of wheel members for detecting the number of tickets which pass through the ticket path;

means for permanently defacing the tickets comprising a rotating cutting blade mounted in the ticket path which severs the tickets after passing through both sets of wheel members;

a motor and transmission for rotating each of the drive wheels and the cutting blade.

2. The apparatus of claim 1 wherein the sensor means for detecting the number of tickets which pass through the ticket path comprises a sensor for detecting each ticket which passes through the ticket path; and means to tally the number of tickets which pass through the apparatus, said tally means being in communication with the sensor.

3. The apparatus of claim 2 wherein said tickets are substantially opaque and a gap is provided between each ticket; and the sensor comprises a light sensor which is aligned to detect the passage of each of the gaps between the tickets.

4. The apparatus of claim 2 wherein the tally means includes a counter for providing an operator with the total number of tickets processed by the apparatus.

5. The apparatus of claim 2 wherein an obstruction is provided between the sensor and the cutting blade to prevent dust from contaminating the sensor.

6. The apparatus of claim 1 wherein means are provided to produce and maintain a bias of the idler wheels against the drive wheels.

7. The apparatus of claim 1 wherein said tickets are substantially opaque and an opening is provided between each ticket; and the sensor comprises a light sensor which is aligned to detect the passage of each of the openings between the tickets.

8. The apparatus of claim 7 wherein the sensor is coupled to means for tallying the number of tickets handled by the apparatus.

9. The apparatus of claim 8 wherein the tally means includes a counter for providing an operator with the total number of tickets processed by the apparatus.

10. The apparatus of claim 1 wherein the rotating cutting blade mounted in the ticket path comprises a serrated wheel positioned perpendicular to the ticket path so to slice each ticket into at least two separate pieces.

11. The apparatus of claim 1 wherein means are provided between each of the wheels and the transmission to transfer the rotational movement of the motor and transmission to each of the drive wheels so that each drive wheel rotates at the same rate of speed.

12. The apparatus of claim 11 wherein said means to transfer the rotational movement includes a pulley between each of the drive wheels.

13. The apparatus of claim 1 wherein gearing is provided between the cutting wheel and the transmission to transfer the rotational movement of the motor and transmission to the cutting wheel so that the cutting wheel rotates substantially faster than the rate of rotation of the drive wheels.

* * * * *